US005507997A

United States Patent [19]

Evain

[11] Patent Number: 5,507,997

[45] Date of Patent: Apr. 16, 1996

[54] PROCESS FOR PREPARING A THERMAL BONDABLE FIBER

[75] Inventor: Eric J. Evain, New Castle, Del.

[73] Assignee: Montell North America Inc., Wilmington, Del.

[21] Appl. No.: 331,319

[22] Filed: Oct. 28, 1994

Related U.S. Application Data

[63] Continuation-in-part of Ser. No. 221,305, Mar. 31, 1994, abandoned.

[51] Int. Cl.[6] ..... B29C 35/10; B29C 71/04

[52] U.S. Cl. ..... 264/464; 264/176.1; 264/476; 264/477

[58] Field of Search ..... 264/22, 176.1, 264/211.14, 232, 340, 464, 476, 477

[56] References Cited

U.S. PATENT DOCUMENTS

| | | | |
|---|---|---|---|
| 3,278,255 | 10/1966 | Chen et al. | 8/115.52 |
| 4,247,496 | 1/1981 | Kawakami et al. | 264/22 |
| 4,473,677 | 9/1984 | Pellegrini et al. | 524/109 |
| 4,575,188 | 3/1986 | Ueba | 385/141 |
| 4,818,587 | 4/1989 | Ejima et al. | 428/198 |
| 5,160,464 | 11/1992 | Ward et al. | 264/22 |
| 5,246,637 | 9/1993 | Matsuura et al. | 264/22 |
| 5,281,378 | 1/1994 | Kozulla | 264/83 |
| 5,318,735 | 6/1994 | Kozulla | 264/83 |

FOREIGN PATENT DOCUMENTS

| | | |
|---|---|---|
| 4963 | 10/1979 | European Pat. Off. . |
| 513538 | 11/1992 | European Pat. Off. . |
| 630996 | 12/1994 | European Pat. Off. . |

*Primary Examiner*—Leo B. Tentoni

[57] ABSTRACT

A process for preparing thermal bondable fibers including exposing molten fiber grade polymer to electromagnetic radiation at the one or more orifices of the spinneret and the upper portion of the spin line, and the fibers prepared therefrom.

7 Claims, 1 Drawing Sheet

PROCESS FOR PREPARING A THERMAL BONDABLE FIBER

The application is a continuation-in-part of the U.S. application, Ser. No. 08/221,305, filed Mar. 31, 1994, and now abandoned.

FIELD OF THE INVENTION

This invention relates to a process of preparing fibers, in particular, an improved process of preparing thermal bondable fibers of fiber grade material.

BACKGROUND OF THE INVENTION

Fibers of certain thermoplastic materials are used widely in the manufacturing of thermally bonded products, such as nonwoven textiles, by various processes. Said processes, such as calendering and spun bonding, require that the fibers have the capability of thermally bonding at temperatures lower than the melting point of the particular polymer(s) from which they are made, and that the fibers and articles manufactured therefrom be resistant to aging, yellowing and color variations caused by gas fading and oxidation.

There have been various attempts made to improve the thermal bondability of fibers, such as incorporating additives into the fiber grade polymer, elevating of spinning temperatures, forming fibers having two components and modifying the fiber surface. For example, U.S. Pat. No. 4,473,677 to Pellegrini et al discloses adding a dianhydride of a 3,3', 4,4' benzophenone tetracarboxylic acid or an alkyl derivative thereof to polyolefins to improve the thermal bonding of the fibers prepared therefrom. However, substantial problems are encountered during spinning at elevated temperatures and relatively slow spinning speeds are required.

Another approach is to add to the fiber grade polymer a low melting material, such as oligomers and waxes. The disadvantage of this approach is that the process must be modified to ensure adequate mixing of the materials so that gels are not formed in the fiber.

In the approach where fibers are formed from two different polymers, one component of the fiber has a lower melting point than the other, and covers the surface of the other component which has a higher melting point. These fibers are generally referred to as a "sheath-core" or "side-by-side" bicomponent fibers. The lower melting component enables thermal bonding at a temperature below the melting point of the fiber core.

Another approach is to modify the surface of the fiber once the fiber has been formed. Typically, these fibers contain only one fiber grade polymer, such as "skin fiber". Modification of the fiber surface can be obtained using various methods, such as irradiation, plasma treatment, ozone treatment, corona discharge treatment or chemical treatment.

In the typical process of melt spinning, the polymer is heated in an extruder to the melting point and the molten polymer is pumped at a constant rate under pressure through a spinneret containing one or more orifices of desired diameter, thereby producing filaments of the molten polymer. The molten polymer filaments are fed downward from the face of the spinneret into a cooling stream of gas, generally air. The filaments of molten polymer are solidified as a result of cooling to form fibers. Depending upon the spinning method used, the fibers are spread to form a fiber web and bonded directly, like in the spun bond method.

Alternatively, in long spin methods, the fibers are gathered together and, if desired, drawn to orient the macromolecular structure of the fibers, and are then wound on bobbins. Bonding or calendering is then performed in a separate step. Generally, if there is any type of modification to be done to the filaments or fibers, such as surface modification carried out by chemical treatment or radiation treatment, the modification of the filaments or fibers takes place after the molten polymer filaments have solidified as a result of cooling to form the fiber, or on the preformed fiber itself.

It has now been found that the thermal bondability of fibers can be enhanced by treating the fiber grade polymer during the formation of the filaments, instead of treating the filaments or fibers after they are formed. The process of the present invention is not limited to any specific fiber preparation technique where a resin is melted and formed into a fiber, such as long spin, short spin, spun bond and melt blown fiber production methods. Nor is the spinning process limited to being carried out in any particular spinning environment, e.g. the presence or absence of oxygen or nitrogen.

SUMMARY OF THE INVENTION

Applicant has found that fibers having improved thermal bondability can be produced at lower spinning temperatures and increased spinning speeds by irradiating the molten fiber grade polymer filaments as soon as the filaments exit the orifices of the spinneret with electromagnetic radiation.

Accordingly, the present invention provides an improved process for the production of thermal bondable fibers comprising exposing the molten polymer filaments to from $1\times10^{-4}$ to 100 W/cm$^2$ of electromagnetic energy at the spinneret face.

DETAILED DESCRIPTION OF THE INVENTION

Figure 1:
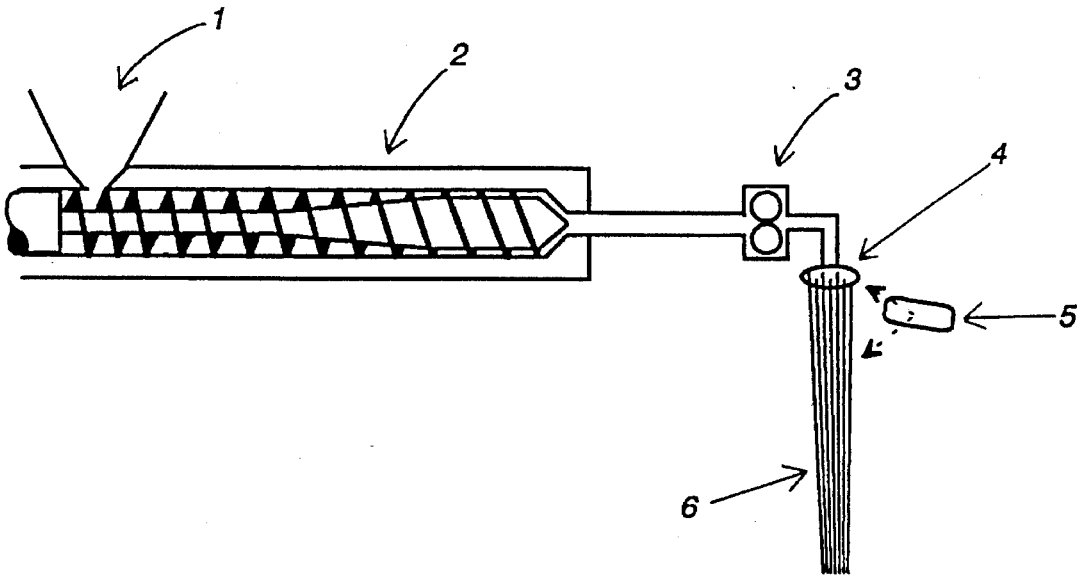
FIG. 1 is a schematic representation of a melt spinning arrangement used in the process of the present invention.

As used herein "spinneret face" is intended to include the upper portion of the spin line and the exit point of the molten material from one or more orifices, having any desired diameter, of the spinneret.

The phrase "fiber grade polymer" as used herein means any polymer that is capable of being spun into filaments to produce a fiber.

Referring to FIG. 1, showing a typical melt-spinning apparatus, for use in preparing fibers according the invention, the fiber grade polymer is charged into a hopper 1, and fed into an extruder 2 of known or conventional type, containing single or multiple screws and equipped with controls for regulating the temperature of the barrel in various zones along the length of the barrel, where the polymer is heated to its melting point. The molten polymer is then fed to a metering pump 3, which delivers the molten polymer at a constant rate to a heated spinneret 4 containing one or more orifices. The fluid molten polymer filaments emerging in a downward direction from the face of the spinneret are exposed to electromagnetic radiation from a radiation source 5. The radiation source is positioned whereby the source encompasses the spinneret face. The molten polymer filaments are then solidified by cooling to form fibers 6.

The filaments produced by the process of this invention are typically combined into one or more fibers of varying thickness. Fibers made up of one filament are generally referred to as monofilament fibers and fibers made up of more than one filament are generally referred to as multifilament fibers. The spun denier of the fibers produced according to the method of this invention range from less than 1 to at least 50 dpf, denier per filament. Denier is the weight in grams of 9000 meters of fiber.

The fiber forming polymers useful in the present invention can be any polymer typically used to prepare fibers. Preferably, the fiber grade polymer is polyethylene, polypropylene, random copolymer of propylene and ethylene, polyisobutylene, polyamide, polyester, polystyrene, polyvinyl chloride, polyacrylate and mixtures thereof. Most preferred is polypropylene and random copolymers of propylene and ethylene.

In the process of the present invention the electromagnetic radiation can be ultraviolet, visible or infrared radiation. The total amount of electromagnetic energy that reaches the filament(s), referred to as irradiance, can be adjusted by changing the distance between the source of the radiation and the filament(s), changing the wavelength emitted by the source, and by changing the power, intensity, of the source. In the present invention, the total amount of electromagnetic energy that reaches the filament(s) is from $1\times10^{-4}$ to 100 W/cm$^2$, preferably from $1\times10^{-2}$ to 50 W/cm$^2$ and, most preferably, from $1\times10^{-1}$ to 10 W/cm$^2$.

Conventional additives may be blended with the fiber forming polymer used to produce the thermal bondable fibers of the present invention. Such additives include, stabilizers, antioxidants, antislip agents, antistatic agents, flame retardants, nucleating agents, pigments, antisoiling agents, photosensitizers and the like.

The present invention will be illustrated in greater detail with reference to the examples of the invention set forth below.

EXAMPLE 1

Fibers of Profax P-165 propylene homopolymer, stabilized with 100 ppm wt. Irganox 1010 tetrakis[methylene(3,5-di-tert-butyl-4-hydroxyhydrocinnamate)] methane stabilizer, 1000 ppm wt. Irgafos 168 tris-(2,4-di-tert-butylphenyl)phosphite stabilizer and 1000 ppm wt. calcium stearate is prepared by charging the polymer composition into hopper, under a nitrogen blanket and fed into a single screw extruder, where the polymer composition is heated to its melting point. The molten polymer is fed to the meter pump, and pumped at a constant rate under pressure to a spinneret, containing one orifice with a diameter of 0.020 inches. The molten polymer filament emerging downward from the orifice of the spinneret is exposed to 0.88 W/cm$^2$ ultraviolet radiation. The filament of molten polymer is solidified as a result of cooling to form a monofilament fiber, and is collected on the godet. The processing conditions are as follows:

| | |
|---|---|
| Extruder Feed Zone Temp. | 220° C. |
| Metering Pump Temp. | 300° C. |
| Spinneret Temp. | 300° C. |
| Fiber Spun Denier | 2 g/9000 m |
| Godet Take-up Speed | 1000 m/min |

The monofilament fibers prepared above were then tested for bond strength according to the following procedure. The fibers were cut into 400 mm lengths. The samples weighed between 0.160 and 0.170 grams. The fibers were then mechanically twisted eighty times and folded in half. The bundle was hand twisted six times and allowed to wrap around itself. The sample was bonded in a Sentinel Model 1212 heat sealer at 40 psi for 1.50 seconds at the desired temperature. The force required to separate the bonded segments (in grams) was recorded on an Instron Model 114 universal testing machine.

The results are set forth below in Table 1.

COMPARATIVE EXAMPLE 1

Fibers were prepared according to the procedure of Example 1 using the same ingredients and processing conditions, except that the molten polymer filament emerging downward from the face of the spinneret was not exposed to the ultraviolet radiation.

The samples used to determine the bond strength were prepared and tested according to the method set for in Example 1.

The results of the thermal bonding are set forth below in Table 1.

TABLE 1

| | Bonding Temperatures | | | |
|---|---|---|---|---|
| | 135° C. | 140° C. | 145° C. | 150° C. |
| Ex. 1 | 528 g | 553 g | 896 g | 1650 g |
| Comp. Ex. 1 | 328 g | 402 g | 556 g | 985 g |

It can be seen that the bonding strength of the fibers of the present invention, even at the lower bonding temperature, is substantially higher than the bonding strength of the fibers of the Comparative Example 1 at the same bonding temperature.

EXAMPLE 2

Fibers of propylene homopolymer having a MFR of 2.9 g/10 min., stabilized with Irganox 1076 octadecyl-3-(3',5'-di-tert-butyl- 4'-hydroxyphenyl) propanoate, 100 ppm wt. Irganox 1010 tetrakis[methylene(3,5-di-tert-butyl-4-hydroxyhydrocinnamate)] methane stabilizer, 1000 ppm wt. Irgafos 168 tris(2,4-di-tert butylphenyl)phosphite stabilizer and 1000 ppm wt. calcium stearate are prepared by according to the process of Example 1, except the processing conditions were as follows:

| | |
|---|---|
| Extruder Feed Zone Temp. | 220° C. |
| Metering Pump Temp. | 275° C. |
| Spinneret Temp. | 275° C. |
| Fiber Spun Denier | 9 g/9000 m |
| Godet Take-up Speed | 1000 m/min |
| Ultraviolet radiation | 2.8 W/cm$^2$ |

The samples used to determine the bond strength were prepared and tested according to the method set for in Example 1.

COMPARATIVE EXAMPLE 2

Fibers were prepared according to the procedure of Example 2 using the same ingredients and processing conditions, except that the molten polymer filament emerging downward from the face of the spinneret was not exposed to the ultraviolet radiation.

The samples used to determine the bond strength were prepared and tested according to the method set for in Example 1.

The results of the thermal bonding are set forth below in Table 2.

TABLE 2

| | Bonding Temperatures | | | |
|---|---|---|---|---|
| | 130° C. | 140° C. | 145° C. | 150° C. |
| Ex. 2 | 269 g | 534 g | 1033 g | 1958 g |
| Comp. Ex. 2 | 160 g | 236 g | 271 g | 492 g |

The fibers of the present invention demonstrate better bonding strength as compared to the fibers of Comparative Example 2.

EXAMPLE 3

Fibers of Profax P-165 propylene homopolymer stabilized with Irganox 1076 octadecyl-3-(3',5'-di-tert-butyl-4'-hydroxyphenyl) propanoate, 100 ppm wt. Irganox 1010 tetrakis[methylene(3,5-di-tert-butyl-4-hydroxyhydrocinnamate)] methane stabilizer, 1000 ppm wt. Irgafos 168 tris-(2,4-di-tert-butylphenyl)phosphite stabilizer and 1000 ppm wt. calcium stearate were prepared by according to the process of Example 1, except the processing conditions were as follows:

| | |
|---|---|
| Extruder Feed Zone Temp. | 220° C. |
| Metering Pump Temp. | 300° C. |
| Spinneret Temp. | 300° C. |
| Fiber Spun Denier | 2 g/9000 m |
| Godet Take-up Speed | 4000 m/min |
| Ultraviolet radiation | 0.88 W/cm$^2$ |

The samples used to determine the thermal bonding strength were prepared and tested according to the method set forth above in Example 1.

The results are set forth below in Table 3.

COMPARATIVE EXAMPLE 3

Fibers were prepared according to the procedure of Example 4 using the same ingredients and processing conditions, except that the molten polymer filament emerging downward from the face of the spinneret was not exposed to the ultraviolet radiation.

The samples used to determine the bond strength were prepared and tested according to the method set for in Example 1.

The results of the thermal bonding are set forth below in Table 3.

TABLE 3

| | Bonding Temperatures | | | |
|---|---|---|---|---|
| | 135° C. | 140° C. | 145° C. | 150° C. |
| Ex. 3 | 528 g | 553 g | 896 g | 1650 g |
| Comp. Ex. 3 | 328 g | 403 g | 556 g | 985 g |

The fibers of the present invention demonstrate better bonding strength as compared to the fibers of Comparative Example 3.

EXAMPLE 4

Fibers of Profax P-165 propylene homopolymer, stabilized with 100 ppm wt. Irganox 1010 tetrakis[methylene(3,5-di-tert-butyl-4-hydroxyhydrocinnamate)] methane stabilizer, 1000 ppm wt. Irgafos 168 tris-(2,4-di-tert-butylphenyl)phosphite stabilizer and 1000 ppm wt. calcium stearate were prepared by according to the process of Example 1, except the processing conditions were as follows:

| | |
|---|---|
| Extruder Feed Zone Temp. | 220° C. |
| Metering Pump Temp. | 250° C. |
| Spinneret Temp. | 250° C. |
| Fiber Spun Denier | 2 g/9000 m |
| Godet Take-up Speed | 2250 m/min |
| Ultraviolet radiation | 0.88 W/cm$^2$ |

The samples used to determine the thermal bonding strength were prepared and tested according to the method set forth above in Example 1.

The results are set forth below in Table 4.

COMPARATIVE EXAMPLE 4

Fibers were prepared according to the procedure of Example 4 using the same ingredients and processing conditions, except that the molten polymer filament emerging downward from the face of the spinneret was not exposed to the ultraviolet radiation.

The samples used to determine the bond strength were prepared and tested according to the method set for in Example 1.

The results are set forth below in Table 4.

TABLE 4

| | Bonding Temperatures | | |
|---|---|---|---|
| | 130° C. | 140° C. | 145° C. |
| Ex. 4 | 196 g | 341 g | 533 g |
| Comp. Ex. 4 | 132 g | 291 g | 350 g |

The fibers of the present invention demonstrate better bonding strength as compared to the fibers of Comparative Example 4.

The thermal bondable fibers prepared according to the process of the present invention can be used in the manufacturing of nonwovens, by spun bonded and melt blown processes. Nonwovens are useful in the production of personal hygiene products, for example, infant care and adult incontinence products, protective covering, for example surgical gowns and shoe covers and other disposable medical and clothing products.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

I claim:

1. In a process for preparing a thermal bondable fiber, which includes extruding fluid molten polymer downwardly through a spinneret having a spinneret face containing at least one orifice through which a fluid molten polymer filament emerges and is subsequently solidified to form a fiber, the improvement comprising exposing said fluid molten polymer filament to an electromagnetic energy of from $1\times10^{-4}$ to 100 W/cm$^2$ as it exits the orifice of the spinneret.

2. The process of claim 1, wherein said thermal bondable fiber comprises a polymer selected from the group consisting of polyethylene, polypropylene, random copolymer of propylene and ethylene, polyisobutylene, polyamide, polyester, polystyrene, polyvinyl chloride, polyacrylate and mixtures thereof.

3. The process of claim 1, wherein the source of said electromagnetic energy is selected from the group consisting of ultraviolet radiation, visible radiation and infrared radiation.

4. The process of claim 3, wherein said source is ultraviolet radiation.

5. The process of claim 1, wherein the energy is from $1\times10^{-2}$ cm to 50 W/cm$^2$.

6. The process of claim 1, wherein the energy is from $1\times10^{-1}$ cm to 10 W/cm$^2$.

7. A process for preparing a thermal bondable fiber, comprising i) extruding a molten polymer through a spinneret face to form a plurality of molten polymer filaments;

ii) exposing said molten polymer filaments to an electromagnetic energy of from $1\times10^{-4}$ to 100 W/cm$^2$; and iii) solidifying said molten polymer filaments to form thermal bondable fibers.

* * * * *

UNITED STATES PATENT AND TRADEMARK OFFICE

CERTIFICATE OF CORRECTION

PATENT NO. : 5,507,997

DATED : April 16, 1996

INVENTOR(S) : Eric J. Evain

It is certified that error appears in the above-indentified patent and that said Letters Patent is hereby corrected as shown below:

At col. 8, line 8, before "molten" insert --fluid--.

At col. 8, line 8, after "polymer" insert --downwardly--.

At col. 8, line 9, before "molten" insert --fluid--.

At col. 8, line 10, before "molten" insert --fluid--.

At col. 8, line 11, after "$W/cm^2$" insert --as they exit the spinneret face--.

At col. 8, line 13, before "molten" insert --fluid--.

Signed and Sealed this

Sixteenth Day of July, 1996

Bruce Lehman

*Attest:*

BRUCE LEHMAN

*Attesting Officer*

*Commissioner of Patents and Trademarks*